US005839198A

United States Patent [19]

McCoy

[11] Patent Number: 5,839,198

[45] Date of Patent: Nov. 24, 1998

[54] RAZOR WITH INTEGRAL HOLDING MEANS

[75] Inventor: Clare McCoy, Milford, Conn.

[73] Assignee: Warner-Lambert Company, Morris Plains, N.J.

[21] Appl. No.: 882,058

[22] Filed: Jun. 25, 1997

[51] Int. Cl.[6] ..... B26B 21/40

[52] U.S. Cl. ..... 30/537; 30/298.4

[58] Field of Search ..... 30/537, 296.1, 30/298.4, 526; D28/48

[56] References Cited

U.S. PATENT DOCUMENTS

| | | | |
|---|---|---|---|
| 2,320,374 | 6/1943 | Monnet | 30/74.1 |
| 2,547,288 | 4/1951 | Sandlie | 30/537 |
| 3,111,757 | 11/1963 | Dubofsky | 30/537 |

FOREIGN PATENT DOCUMENTS 545789 6/1942 United Kingdom .

OTHER PUBLICATIONS

"Braun pocket", Braun Product Catalog, Fall 1992.

*I.D. Magazine,* May 1997.

*Primary Examiner*—Hwei-Siu Payer

*Attorney, Agent, or Firm*—Charles W. Almar

[57] ABSTRACT

The present invention is directed to a razor for wet shaving having an integral holder. The integral holder allows the user of the razor to conveniently place the razor on a surface for temporary storage during shaving. The holder is preferably such so that it does not interfere with the actual use of the razor, but may be easily employed as desired to store the razor. One preferred embodiment of the holder consists of a plurality of legs which fold outward from the handle of the razor so that the razor may be stored in a standing position. A second preferred embodiment of the holder consists of a suction cup which is affixed to the body of the razor handle. This second preferred embodiment would be especially preferred among users who may wish to temporarily store the razor on a shower wall and could easily do so by attaching the suction cup to the shower wall.

1 Claim, 5 Drawing Sheets

RAZOR WITH INTEGRAL HOLDING MEANS

BACKGROUND OF THE INVENTION

1. Field of the Invention

This invention relates to wet shave razors having integral means for holding the razor.

2. Description of Related Art

Many commercially available razor systems, both men and women's, are sold with a separate holder of some sort, such as a tray or stand. Anecdotal evidence suggests that a significant number of individuals do not use the separate tray or stand. Often the individual does not want or use the holder. Reasons for the lack of interest and use vary from a misunderstanding of the purpose of the holder to a difficulty in easily utilizing the holder in the desired manner. One such potential difficulty is that the holder is not always readily available when and where the user needs to temporarily store the razor. This problem is especially prevalent among women users who frequently need to free both hands to lather while shaving in the shower or bath, resulting in a situation where the razor needs to be temporarily placed elsewhere. Further exacerbating the problem is the fact that because women often shave in a shower a separate holder can easily be placed in a different location, such as on the sink, so that it is not available when needed. Consequently, it would be advantageous to provide a razor with an integral holder means so that the holder is always readily available when needed.

SUMMARY OF THE INVENTION

The present invention is directed to a razor for wet shaving having an integral holding means. The integral holding means allow the user of the razor to conveniently place the razor on a surface for temporary storage during shaving. The holding means are preferably such so that they do not interfere with the actual use of the razor, but may be easily employed as desired to store the razor. One preferred embodiment of the storage means consists of a plurality of legs which fold outward from the handle of the razor so that the razor may be stored in a standing position. A second preferred embodiment of the storage means consists of a suction cup which is affixed to the body of the razor handle. This second preferred embodiment would be especially preferred among users who may wish to temporarily store the razor on a shower wall and could easily do so by attaching the suction cup to the shower wall.

DETAILED DESCRIPTION OF THE PREFERRED EMBODIMENTS

Reference will now be made in detail to the presently preferred embodiments of the invention.

Figure 1:
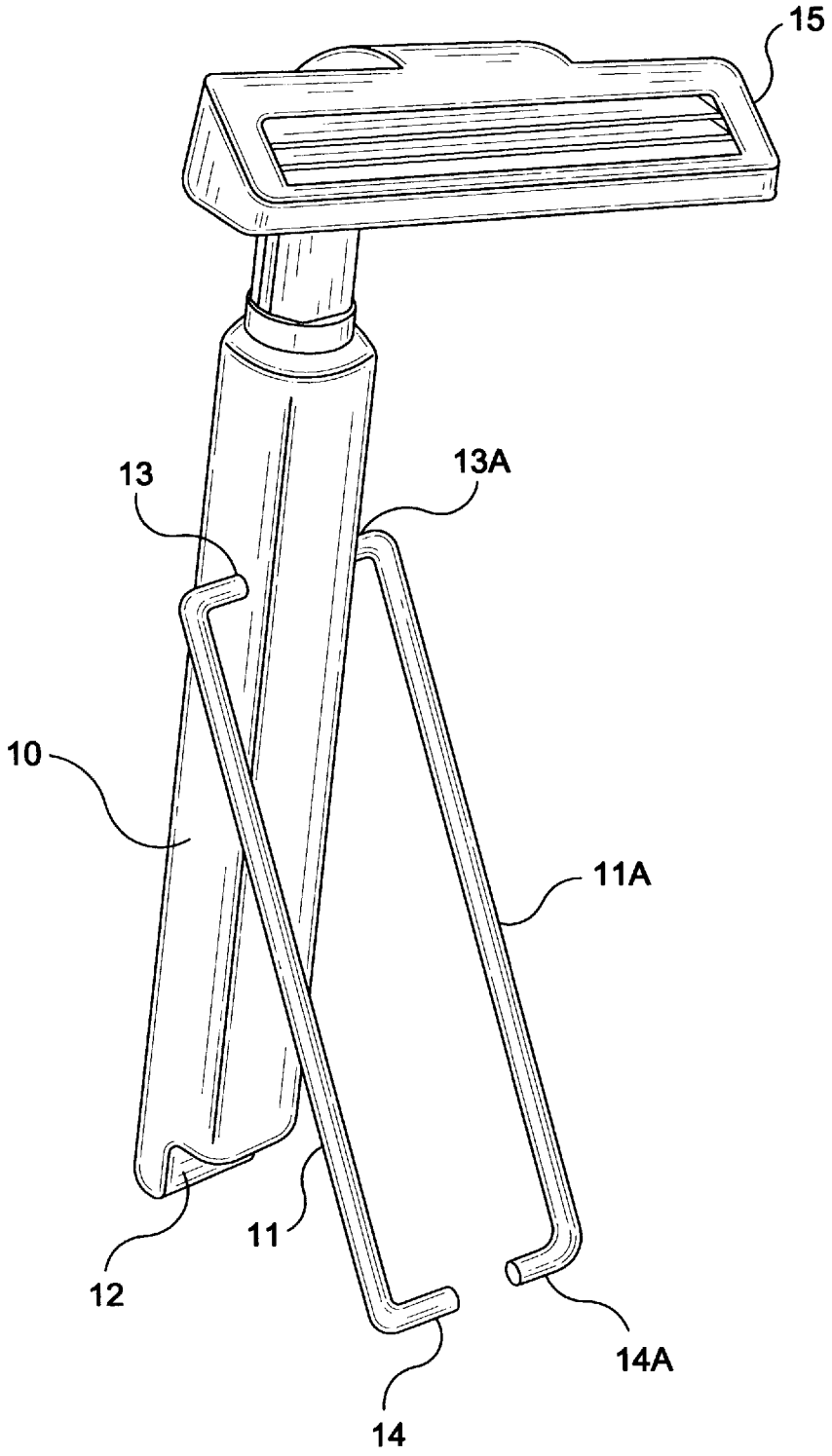
FIG. 1 is a perspective view of the razor holding means
Figure 2:
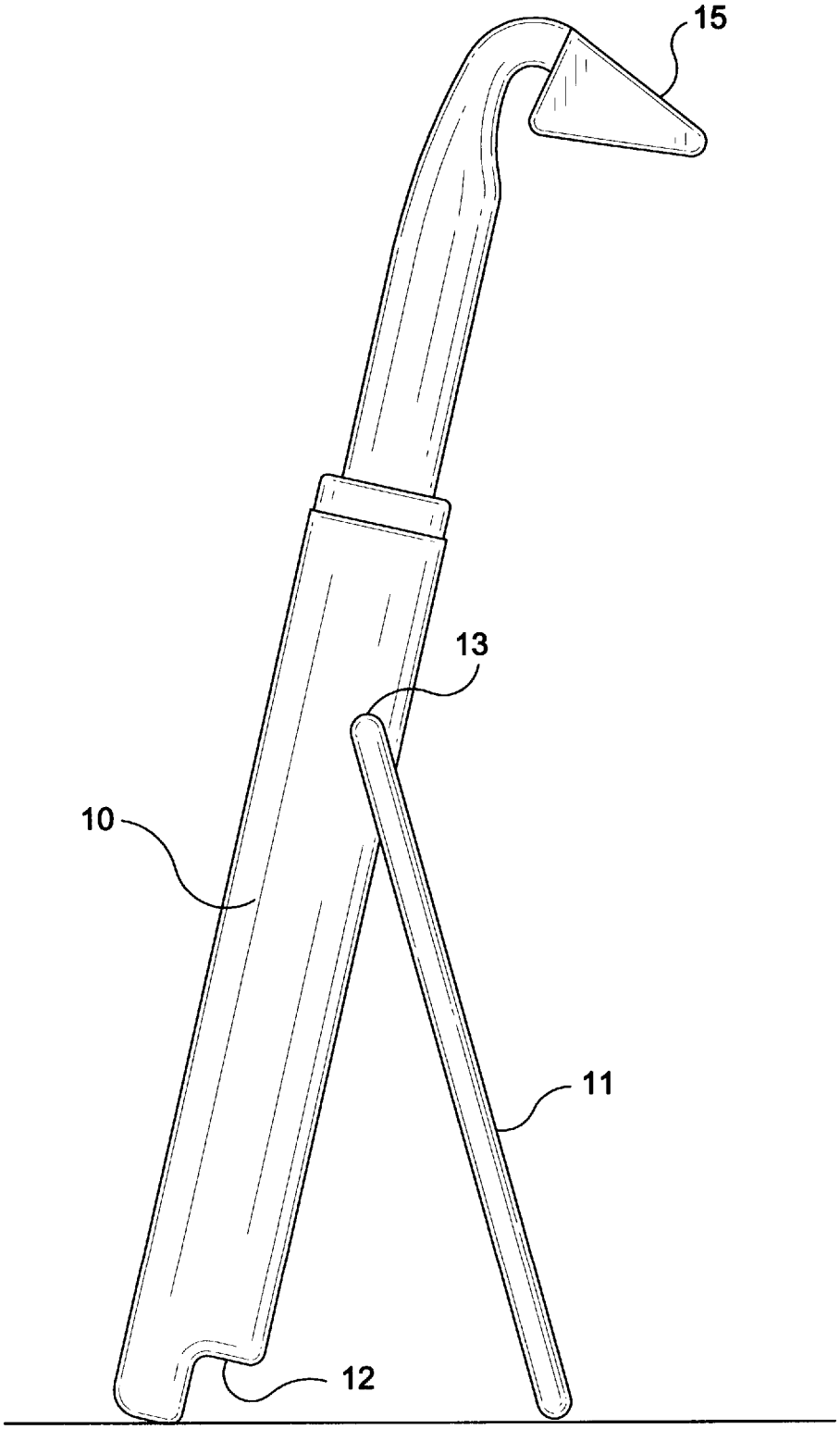
FIG. 2 is a side view of the razor holding means as extended away from the razor handle.
Figure 3:
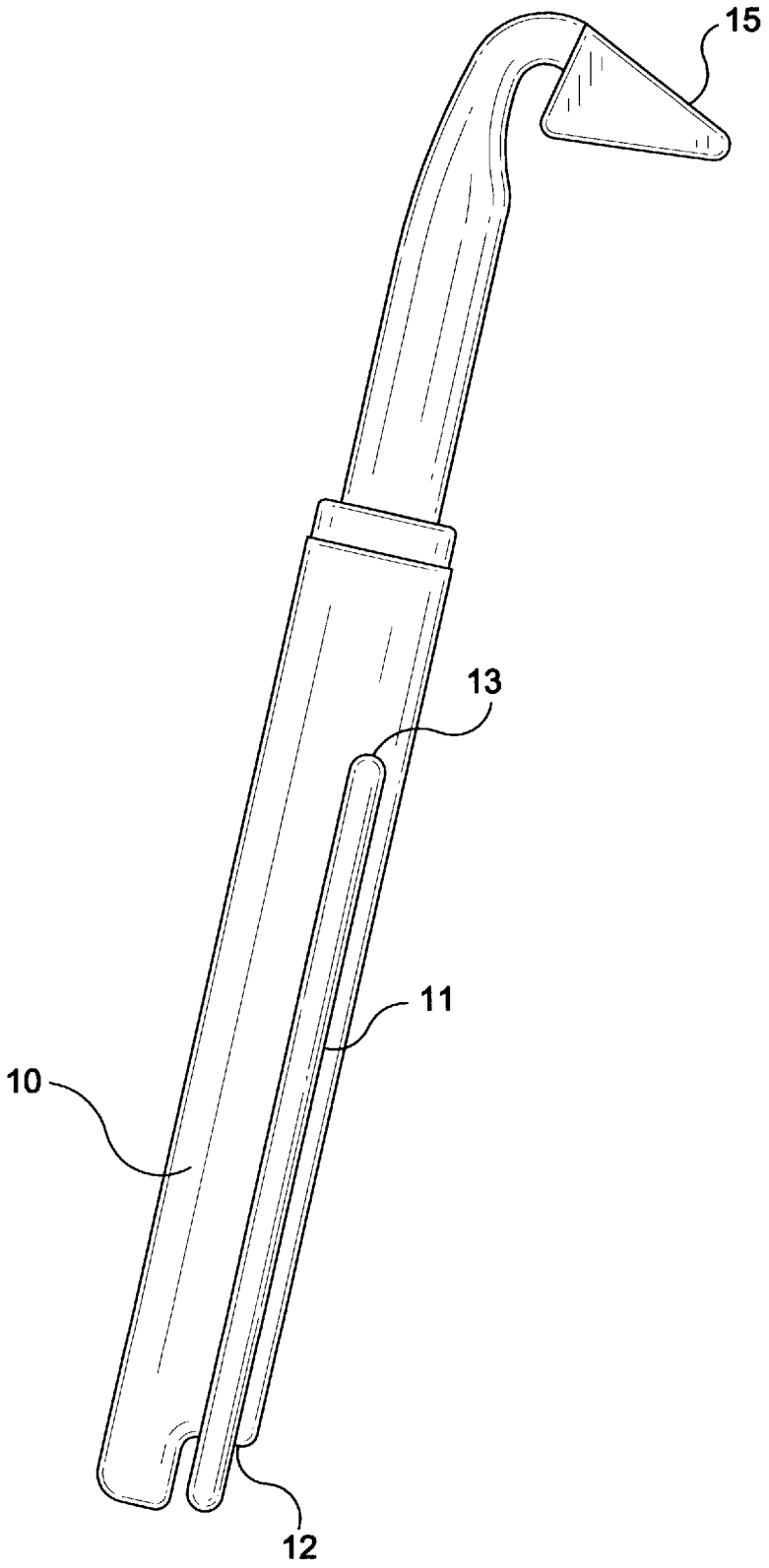
FIG. 3 is a side view of the razor holding means as folded against the razor handle.

The present invention comprises a wet shave razor which has integral means for holding the razor on either a horizontal or a vertical surface. As used herein, a wet shave razor is a razor which is non-electric and is commonly used in conjunction with shaving cream and water to produce a comfortable shave. As illustrated in FIGS. 1–3, a preferred embodiment of the present invention comprises a razor handle 10 with either a permanent or replaceable razor head 15. Fold down legs 11, 11 A extend from a pivot 13 on the razor handle. The legs may be constructed of either the same or a different material, such as plastic or metal, than the razor handle and are permanently affixed to the razor handle, either through a snap fit or a friction fit between elements of the razor handle. The legs pivot about pivots 13, 13A so that they may be either folded inward flush against the razor handle to avoid interference with shaving (as in FIG. 3), or outward to support the razor in a standing position (as in FIGS. 1 and 2) on a substantially horizontal surface.

The legs preferably comprise a foot section 14, 14A to provide stability to the razor when it is in the standing position. Notch 12 is preferably provided adjacent to the bottom of the handle to accomodate the foot sections of the legs when the legs are in the inward position. The foot sections may be snapped into notch 12 to prevent the legs from pivoting outward during use and interfering with the shaving process. When the razor is in the standing position, it will remain in that position until further manual interaction. This embodiment is especially preferred for individuals who use the razor near a sink or while seated in a bathtub because it allows for quick and easy placement of the razor in a safe location on a horizontal surface while the user performs other functions.

Figure 4:
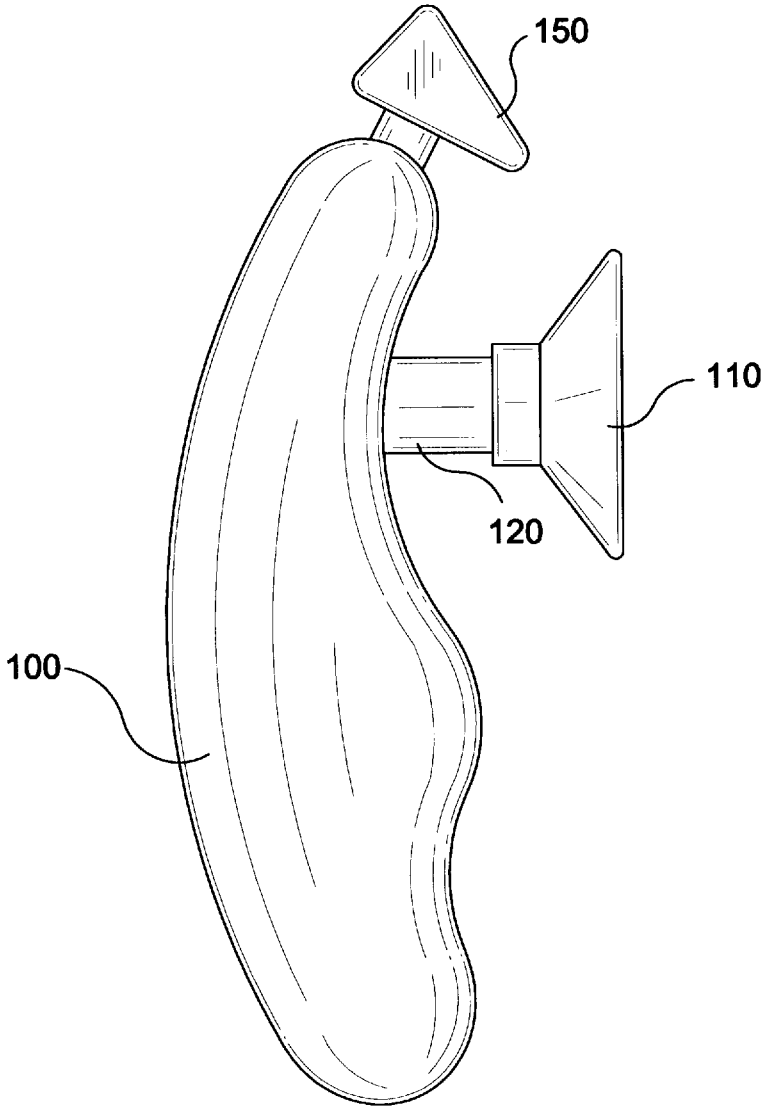
FIG. 4 is a side view of an embodiment of the razor holding means comprising an integral suction cup.
Figure 5:
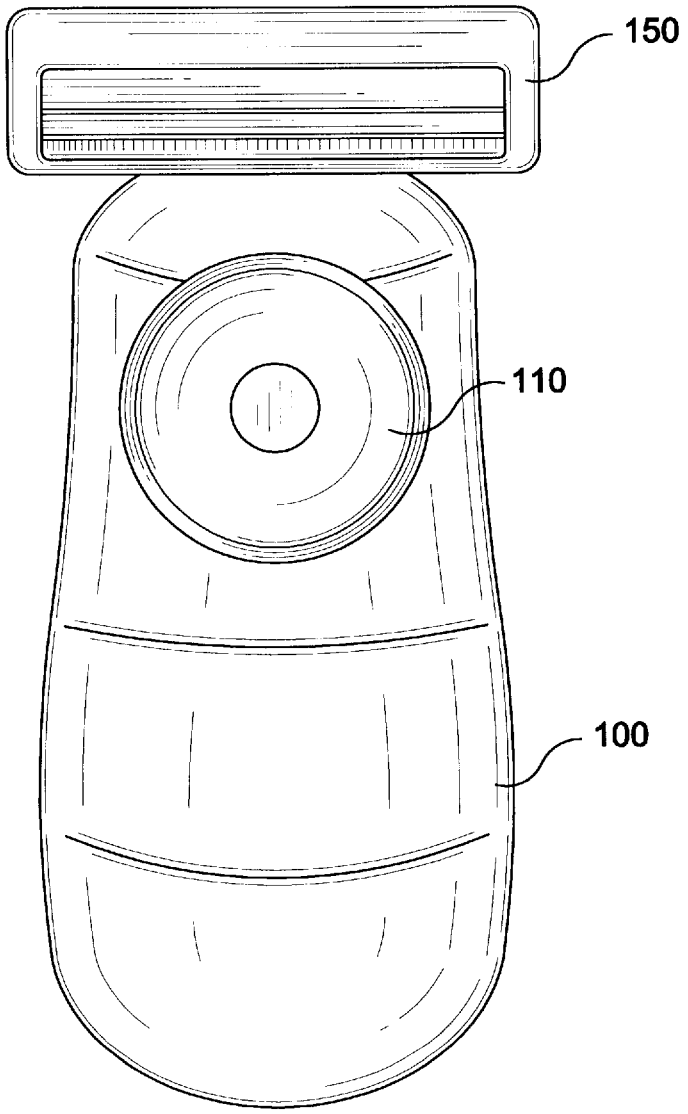
FIG. 5 is a bottom view of the embodiment of the razor holding means comprising an integral suction cup.

A second preferred embodiment of the present invention is illustrated in FIGS. 4 and 5. In this preferred embodiment the razor unit comprises a razor handle 100 and either a permanent or disposable cartridge 150. Holding means, in the form of suction cup 110, are provided on one surface of the razor handle. The suction cup is attached to the razor handle via connector 120. The suction cup allows the razor unit to be affixed to any surface. In the preferred usage, the razor unit is temporarily affixed to a vertical surface such as a shower wall. The user may repeatedly remove and affix the razor unit to the surface as desired. This embodiment is especially preferred for individuals who use the razor while standing in a shower because it allows for quick and easy placement of the razor in a safe location on a vertical surface while the user performs other functions, such as lathering with shaving cream.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A razor unit comprising a handle and integral holding means for temporarily storing the razor unit, wherein the integral holding means comprise a plurality of legs which allow for temporary storage of the razor unit on a substantially horizontal surface and the plurality of legs comprises two legs which pivot inward and outward about a pivot point on the handle of the razor unit, wherein each leg has a top portion adjacent to the pivot point and a lower portion distant from the pivot point and the lower portions of the two legs each comprises a foot section to provide stability when the razor unit is in the standing position and the razor unit is supported in a standing position when the two legs are in the outward position, and wherein the handle further comprises a notch to accomodate the foot sections when the legs are in the inward position.

* * * * *